US008434531B2

(12) United States Patent
Grantham

(10) Patent No.: US 8,434,531 B2
(45) Date of Patent: May 7, 2013

(54) FUEL DISPENSING NOZZLE HOLD OPEN CLIP RELEASE ASSEMBLY

(75) Inventor: Rodger P. Grantham, Springfield, MO (US)

(73) Assignee: Vapor Systems Technologies, Inc., Springsboro, OH (US)

( * ) Notice: Subject to any disclaimer, the term of this patent is extended or adjusted under 35 U.S.C. 154(b) by 0 days.

(21) Appl. No.: 13/609,651

(22) Filed: Sep. 11, 2012

(65) Prior Publication Data

US 2013/0001447 A1 Jan. 3, 2013

Related U.S. Application Data

(62) Division of application No. 12/891,175, filed on Sep. 27, 2010, now Pat. No. 8,286,677.

(51) Int. Cl.
*B65B 3/04* (2006.01)

(52) U.S. Cl.
USPC ..... 141/218; 141/392; 141/206; 251/90; 222/74

(58) Field of Classification Search ..... 141/206, 141/218, 392, 209; 251/89, 90, 111, 153.01; 222/74
See application file for complete search history.

(56) References Cited

U.S. PATENT DOCUMENTS

| | | | |
|---|---|---|---|
| 2,528,696 | A | 11/1950 | Logan et al. |
| 3,072,294 | A | 1/1963 | Myers |
| 3,273,609 | A | 9/1966 | Carder et al. |
| 3,502,121 | A | 3/1970 | Moore et al. |
| 3,521,681 | A | 7/1970 | Wilson |
| 3,653,415 | A | 4/1972 | Boudot et al. |
| 3,719,215 | A | 3/1973 | Murray |
| 3,807,603 | A | 4/1974 | Kisor |
| 3,817,285 | A | 6/1974 | Wilder et al. |
| 3,840,055 | A | 10/1974 | Wostl et al. |
| 3,995,670 | A | 12/1976 | Weidenaar et al. |
| 4,095,629 | A | 6/1978 | Jordan |
| 4,130,148 | A | 12/1978 | Keller |
| 4,175,595 | A | 11/1979 | Noe |
| 4,200,128 | A | 4/1980 | Pokrzywa |
| 4,201,253 | A | 5/1980 | Maloney |
| 4,265,281 | A | 5/1981 | Oberrecht |
| 4,334,560 | A | 6/1982 | Lockwood |
| 4,337,917 | A | 7/1982 | Tesack et al. |
| 4,341,326 | A | 7/1982 | Bravo |
| 4,450,879 | A | 5/1984 | Wood |
| 4,658,987 | A | 4/1987 | Fink, Jr. |
| 4,690,182 | A | 9/1987 | Knaus |
| D299,112 | S | 12/1988 | Downey |
| 4,802,516 | A | 2/1989 | Dahlem |
| 4,811,765 | A | 3/1989 | Giha |

(Continued)

*Primary Examiner* — Timothy L Maust
*Assistant Examiner* — Timothy Kelly
(74) *Attorney, Agent, or Firm* — Stevens & Showalter LLP

(57) ABSTRACT

A fuel dispensing nozzle includes a main body that receives fuel from a fuel source for dispensing the fuel into a fuel tank, an operating lever associated with the main body, a locking device, and a locking device release mechanism. The operating lever is adapted to be actuated by an operator to dispense fuel from the nozzle. The locking device is associated with the operating lever for maintaining the operating lever in a hold open position such that the nozzle continues to dispense fuel without continued actuation of the operating lever by the operator. The locking device release mechanism is associated with the locking device and is adapted to release the operating lever from the hold open position upon the nozzle being stowed in an associated fuel pump cradle.

7 Claims, 12 Drawing Sheets

U.S. PATENT DOCUMENTS

| | | | | |
|---|---|---|---|---|
| 4,913,200 | A | 4/1990 | Carow | |
| 5,004,023 | A | 4/1991 | Monticup, Jr. et al. | |
| 5,118,074 | A | 6/1992 | Weissman | |
| 5,121,777 | A | 6/1992 | Leininger et al. | |
| D333,605 | S | 3/1993 | Powell, Jr. | |
| 5,217,054 | A | 6/1993 | Mollica | |
| 5,240,226 | A | 8/1993 | Bobst | |
| 5,299,607 | A | 4/1994 | Monticup, Jr. | |
| D357,399 | S | 4/1995 | Miller | |
| 5,469,900 | A | 11/1995 | Weeks et al. | |
| 5,482,094 | A | 1/1996 | Mitchell | |
| 5,832,970 | A | 11/1998 | Carow | |
| 6,070,625 | A | 6/2000 | Robinson et al. | |
| 6,227,266 | B1 | 5/2001 | Moore et al. | |
| 6,698,471 | B1 | 3/2004 | Carmack | |
| 6,951,229 | B2 | 10/2005 | Garrison et al. | |
| 7,040,361 | B2 | 5/2006 | Soussan et al. | |
| 7,134,580 | B2 | 11/2006 | Garrison et al. | |
| 7,255,140 | B2 | 8/2007 | Poli | |
| 7,406,988 | B2 | 8/2008 | Mitchell | |
| 8,286,677 | B2 * | 10/2012 | Grantham | 141/218 |
| 2005/0056340 | A1 | 3/2005 | Walker | |
| 2007/0215237 | A1 | 9/2007 | Grantham | |
| 2010/0175786 | A1 | 7/2010 | Martin | |
| 2012/0073701 | A1 | 3/2012 | Grantham | |

* cited by examiner

FUEL DISPENSING NOZZLE HOLD OPEN CLIP RELEASE ASSEMBLY

CROSS-REFERENCE TO RELATED APPLICATION

This application is a division of U.S. patent application Ser. No. 12/891,175 filed Sep. 27, 2010, entitled FUEL DISPENSING NOZZLE HOLD OPEN CLIP RELEASE ASSEMBLY which is incorporated herein by reference in its entirety.

FIELD OF THE INVENTION

The present invention relates generally to a fuel dispensing system for vehicles and, more particularly, to a hold open clip release assembly for a fuel dispensing nozzle that prevents a locking device of the nozzle from being maintained in a hold open position when the nozzle is stowed in a fuel pump cradle.

BACKGROUND OF THE INVENTION

Fuel dispensing nozzles, such as those used for dispensing gasoline into a fuel tank of a vehicle, include an operating lever, also known as a trigger lever, that is actuated by an operator to dispense fuel from the nozzle into the fuel tank of the vehicle. One such nozzle is disclosed in commonly owned U.S. Patent Application Publication No. 2007/0215237, the entire disclosure of which is incorporated by reference herein.

The fuel dispensing nozzle disclosed by the '237 application includes a locking device that releasably retains the operating lever in an "on" or "hold open" position, such that the operator is not required to manually hold the operating lever in the hold open position during fill up. Such locking devices, also known as lock levers, are well known and are provided in many different configurations for maintaining the operating lever in the hold open position.

SUMMARY OF THE INVENTION

In accordance with one aspect of the invention, a fuel dispensing nozzle is provided. The fuel dispensing nozzle comprises a main body that receives fuel from a fuel source for dispensing the fuel into a fuel tank, an operating lever associated with the main body, a locking device, and a locking device release mechanism. The operating lever is adapted to be actuated by an operator to dispense fuel from the nozzle. The locking device is associated with the operating lever for maintaining the operating lever in a hold open position such that the nozzle continues to dispense fuel without continued actuation of the operating lever by the operator. The locking device release mechanism is associated with the locking device and is adapted to release the operating lever from the hold open position upon the nozzle being stowed in an associated fuel pump cradle.

In accordance with another aspect of the invention, an assembly is provided for a fuel dispensing nozzle including an operating lever that is actuated by an operator to cause the nozzle to dispense fuel into a fuel tank. The assembly comprises a locking device and a locking device release mechanism. The locking device is associated with the operating lever for maintaining the operating lever in a hold open position such that the nozzle continues to dispense fuel without continued actuation of the operating lever by the operator. The locking device release mechanism is associated with the locking device and is adapted to release the operating lever from the hold open position upon the nozzle being stowed in an associated fuel pump cradle.

In accordance with yet another aspect of the invention, a fuel dispensing nozzle hold open clip release assembly is provided. The fuel dispensing nozzle hold open clip release assembly comprises a slide bar assembly and a pivot bracket. The slide bar assembly is associated with a nozzle lever guard and comprises a slide bar and a first resilient member. The slide bar is movable between a first position wherein a first end of the slide bar extends beyond the nozzle lever guard and a second position wherein the first end of the slide bar is substantially within the nozzle lever guard. The first resilient member biases the slide bar toward the first position. The pivot bracket is associated with and engages a nozzle hold open clip. The pivot bracket and the hold open clip are mounted for pivotal movement relative to the nozzle lever guard so that the hold open clip can be moved between a nozzle closed position and at least one nozzle hold open position wherein the hold open clip engages at least one detent on a nozzle operating lever. The pivot bracket can be moved between an enable hold open clip position and a disable hold open clip position. A second resilient member is provided for biasing the hold open clip toward the nozzle closed position. The slide bar engages and moves the pivot bracket when moving from the first position to the second position and the pivot bracket in turn moves the hold open clip from the at least one nozzle hold open position to the nozzle closed position.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
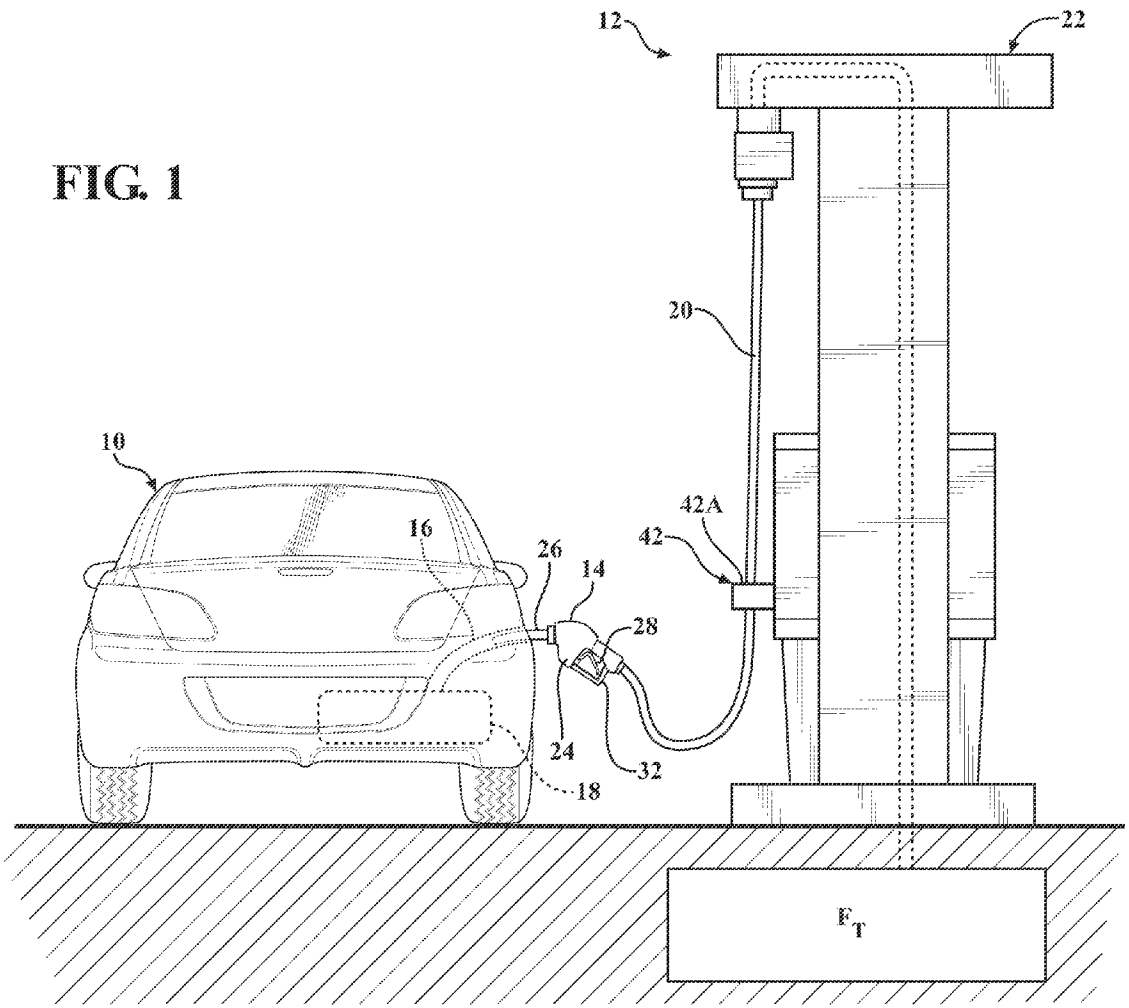
FIG. 1 illustrates a fueling system for a vehicle that includes a fuel dispensing nozzle having a hold open clip release assembly according to an embodiment of the invention.

Referring to FIG. 1, a vehicle 10 is shown being fueled with a fueling system 12. A fuel dispensing nozzle 14 of the fueling system 12 is shown inserted into a filler pipe 16 of a fuel tank 18 of the vehicle 10 during the fueling operation. A fuel delivery hose 20 is connected to the nozzle 14 on one end and to a fuel pump 22 on the opposite end. The fuel delivery hose 20 receives fuel from a fuel source, i.e., a fuel tank $F_T$, which fuel tank $F_T$ may be buried in the ground beneath the fuel pump 22.

The nozzle 14 includes a main body 24 and a spout 26 projecting forwardly from the main body 24. On the main body 24 opposite from the spout 26, the hose 20 is connected to the nozzle 14. The main body 24 includes a standard trigger or operating lever 28, which is coupled to a shut-off assembly (not shown). For a description of the shut-off assembly, see U.S. Patent Application Publication No. 2007/0215237.

Referring to FIGS. 2, 3A, 3B, 4, and 5 (collectively referred to hereinafter as FIGS. 2-5), the operating lever 28 includes a grip 30 for actuation by a user to dispense fuel through the nozzle 14 into the vehicle's fuel tank 18. The main body 24 further includes a lever guard 32 surrounding the operating lever 28. The lever guard 32 may be detachable from the rest of the main body 24 to facilitate repair/replacement of the lever guard 32 and the components attached thereto, which components will be discussed below.

A locking device 34, also known as a lock lever or a nozzle hold open clip, is provided to releasably retain the operating lever 28 in at least one "hold open" or "on" position, as will be described herein. The locking device 34 is arranged for pivotal movement with respect to the lever guard 32 at a first end 34A thereof, and is adapted to engage the operating lever 28 at a second end 34B thereof to retain the operating lever 28 in the at least one hold open position. In the embodiment shown, the locking device 34 in positionable in a nozzle closed position, illustrated in FIGS. 2 and 5, and is also positionable in first and second nozzle hold open positions, illustrated in FIGS. 3A and 3B, respectively. While in the respective nozzle hold open positions, the second end 34B of the locking device 34 engages corresponding first and second detents 28A and 28B on the operating lever 28 to retain the operating lever 28 in respective first and second hold open positions.

As shown in FIGS. 2-5, a resilient member, i.e., a torsion spring 35, is mounted to the lever guard 32 proximate to the first end 34A of the locking device 34 via a rivet 36, pin, or the like, which rivet 36 is coupled to the lever guard 32 and extends through a central aperture 38 of the torsion spring 35 to secure the torsion spring 35 to the lever guard 32. A first end 35A of the torsion spring 35 engages the lever guard 32, and a second end 35B of the torsion spring 35 engages and provides a bias against the locking device 34 to urge the locking device 34 toward the nozzle closed position, i.e., the torsion spring 35 urges rotation of the locking device 34 to cause the second end 34B of the locking device 34 to move away from the detents 28A, 28B of the operating lever 28. It is noted that resilient members other than the torsion spring 35 could be used to bias the locking device 34 toward the nozzle closed position.

A locking device release mechanism 40, also referred to as a hold open clip release assembly, is associated with, i.e., coupled to, the lever guard 32. The locking device release mechanism 40 is used to prevent the locking device 34 from maintaining the operating lever 28 in a hold open position upon the nozzle 14 being stowed in a cradle 42 (see FIGS. 1, 4, and 5) of the fuel pump 22, as will be discussed herein.

The locking device release mechanism 40 in the embodiment shown comprises a slide bar assembly 44 associated with the lever guard 32. The slide bar assembly 44 includes a slide bar 46 movable between a first position, illustrated in FIGS. 2 and 3A, wherein a first end 46A of the slide bar 46 extends beyond the main body 24 of the nozzle 14, i.e., beyond the lever guard 32, and a second position, illustrated in FIGS. 4 and 5, wherein the first end 46A of the slide bar 46 is substantially within the main body 24 of the nozzle 14, i.e., substantially within the lever guard 32. The slide bar 46 may further be positionable in other positions, such as the position shown in FIG. 3B, as will be discussed herein. Further, the first end 46A of the slide bar 46 may have a generally cylindrical shape as illustrated.

The slide bar 46 is secured in the lever guard 32 via a rivet 47 that is coupled to the lever guard 32, i.e., the rivet 47 prevents the slide bar 46 from moving out of the lever guard 32 but the slide bar 46 is able to slide between the lever guard 32 and the rivet 47.

A second end 46B of the slide bar 46 comprises a roller member 49 that is adapted to engage a pivot bracket 48 of the locking device release mechanism 40, which pivot bracket 48 will be described in detail herein.

Figure 6:
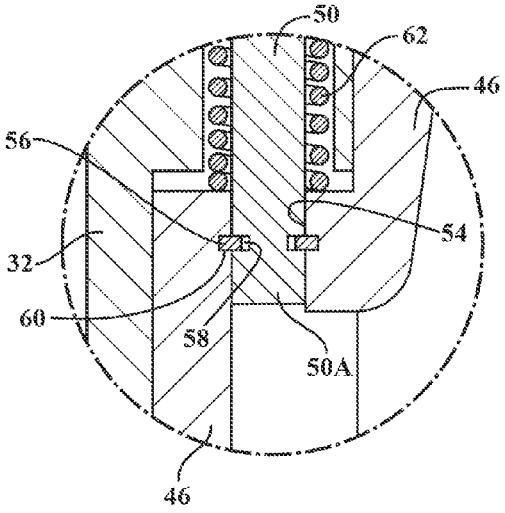
FIG. 6 is an enlarged cross section view illustrating a coupling between a guide rod and a slide bar associated with the hold open clip release assembly illustrated in FIGS. 2, 3A, 3B and 4-5.

The slide bar assembly 44 further comprises a guide rod 50 that slidably extends through a stepped bore 52 in the lever guard 32, i.e., for axial movement relative to a longitudinal portion of the lever guard 32. The guide rod 50 comprises a first end 50A that is coupled to the slide bar 46 and a second end 50B that is free to slide within a first portion of the stepped bore 52 in the lever guard 32. In the embodiment shown, the first end 50A of the guide rod 50 is received in a bore 54 formed in the slide bar 46. The coupling of the first end 50A of the guide rod 50 to the slide bar 46 is effected by a spring pin 56 that is received in corresponding notches 58, 60 formed in the guide rod 50 and the slide bar 46, see FIG. 6, although other suitable coupling structures could be used.

The slide bar assembly 44 additionally comprises a resilient member, e.g., a compression spring 62 as illustrated, which surrounds the guide rod 50 within a second, spring receiving portion of the stepped bore 52 and extends between an internal shoulder 64 in the stepped bore 52 and the slide bar 46. The compression spring 62 urges the slide bar 46 toward the first position as will be described herein.

Figure 7A:
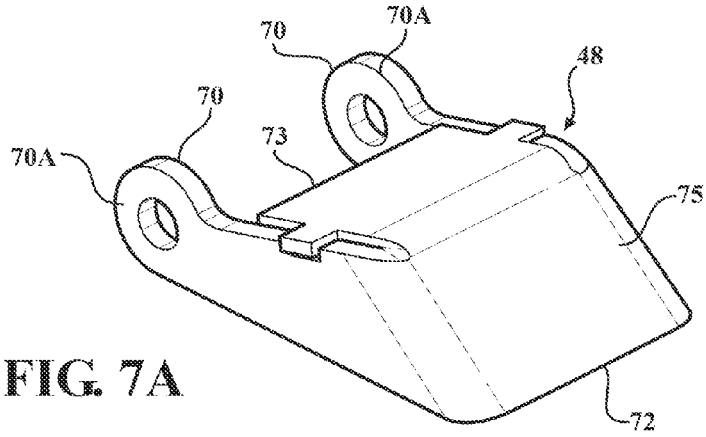
FIGS. 7A and 7B are perspective views of a component of the hold open clip release assembly illustrated in FIGS. 2, 3A, 3B and 4-5.
Figure 7B:
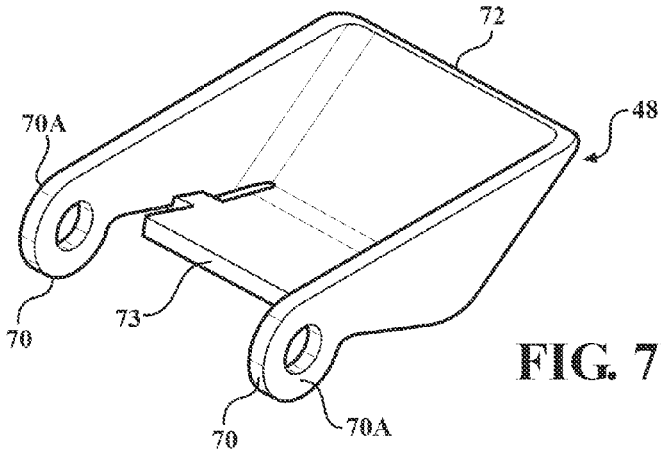

Referring additionally to FIGS. 7A and 7B, the pivot bracket 48 comprises a first end 70 that includes apertured extensions 70A for mounting the bracket 48 to the lever guard 32 using the same rivet 36 that is used for mounting the locking device 34. As the bracket 48 is pivotally moved about its first end 70, a second end 72 of the bracket moves in and out of contact with the lever guard 32. The pivot bracket 48 further comprises a lip 73 that is adapted to engage an extension 74 of the locking device 34 at the first end 34A thereof so that movement of the locking device 34 and the pivot bracket 48 are coordinated.

Figure 2:
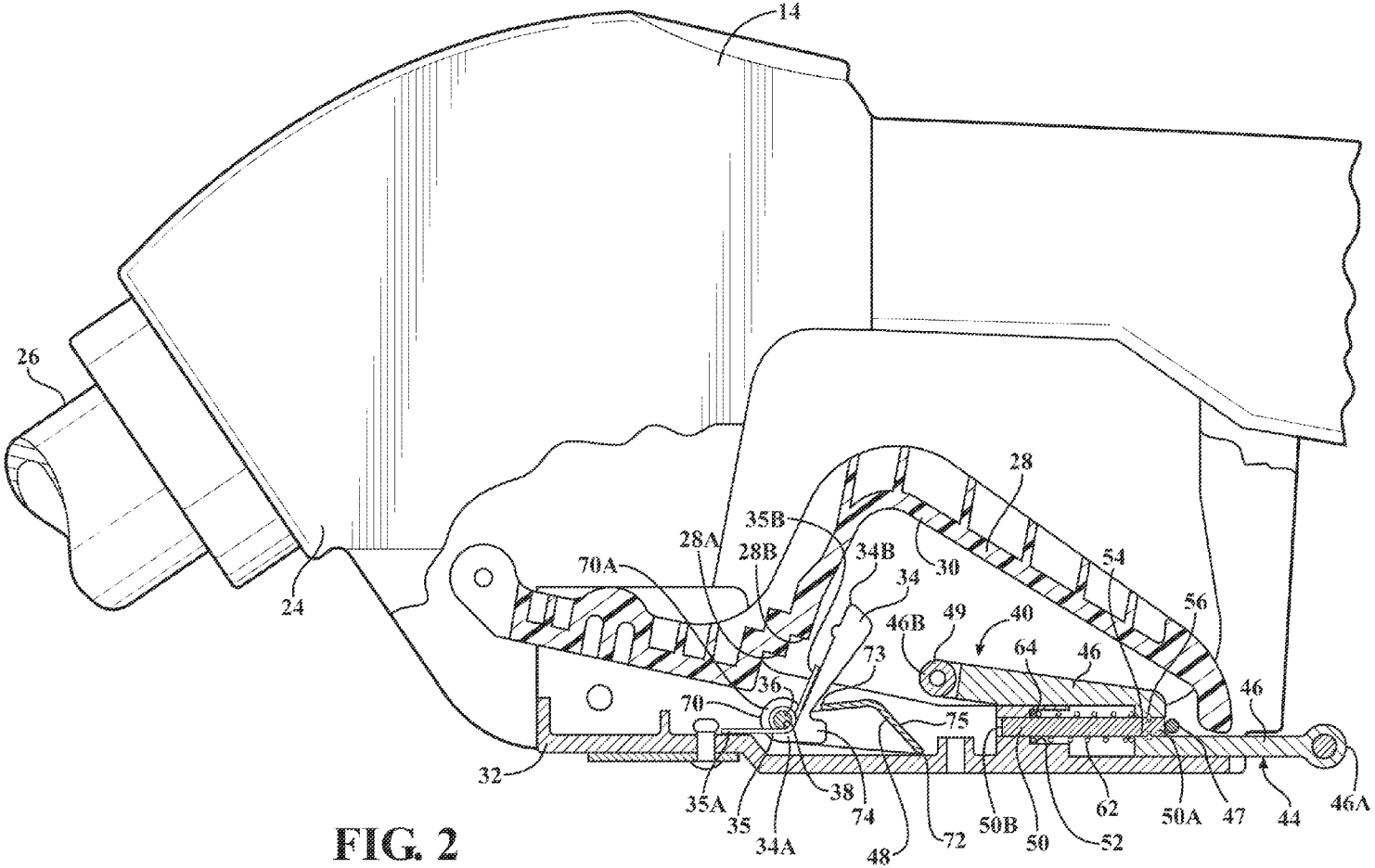
FIGS. 2, 3A, 3B and 4-5 are side views, partially in cross section, illustrating the hold open clip release assembly of the nozzle of claim 1 in successive positions as the nozzle is used to dispense fuel and then stowed in a fuel pump cradle.
Figure 3A:
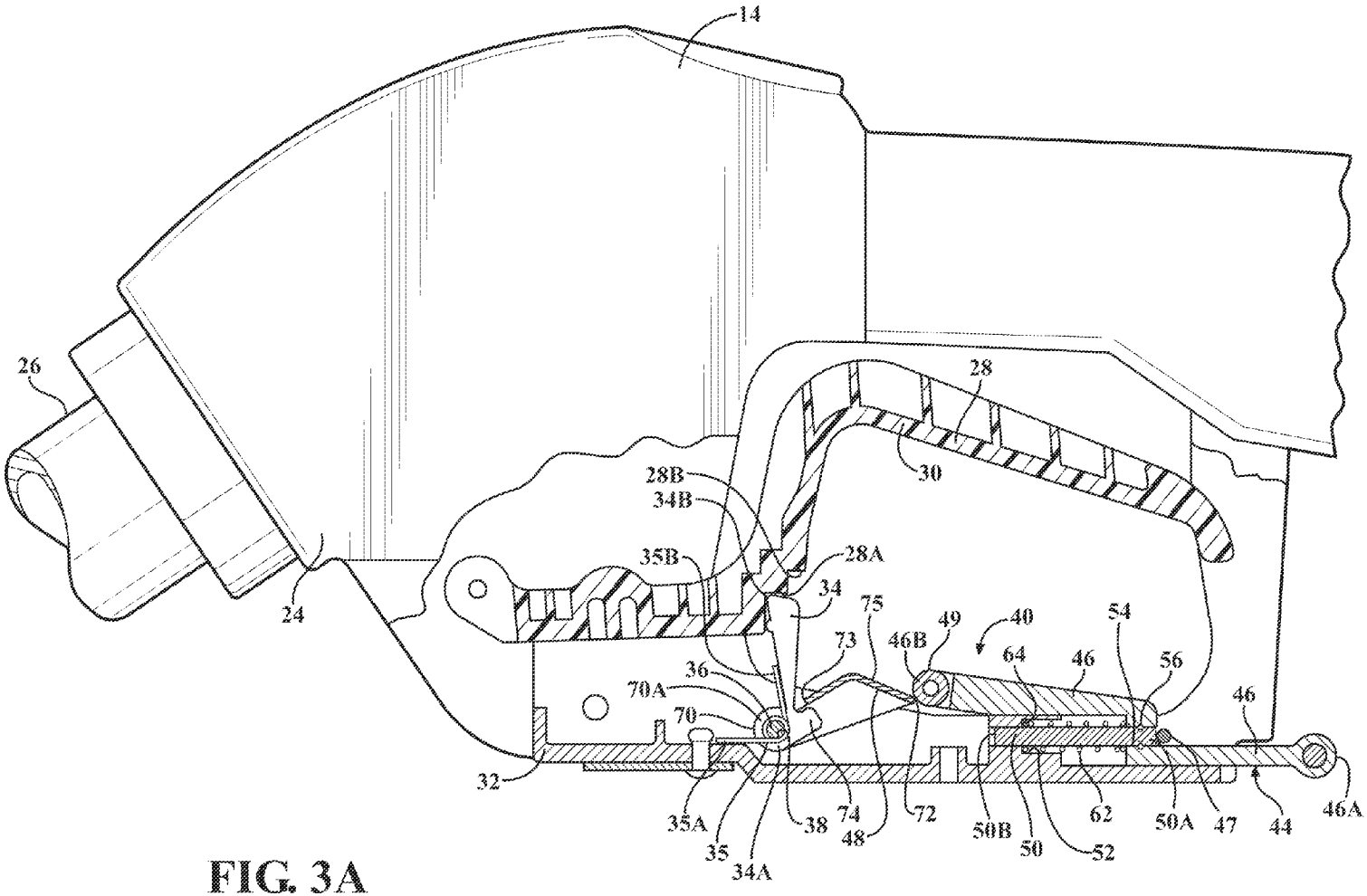
Figure 3B:
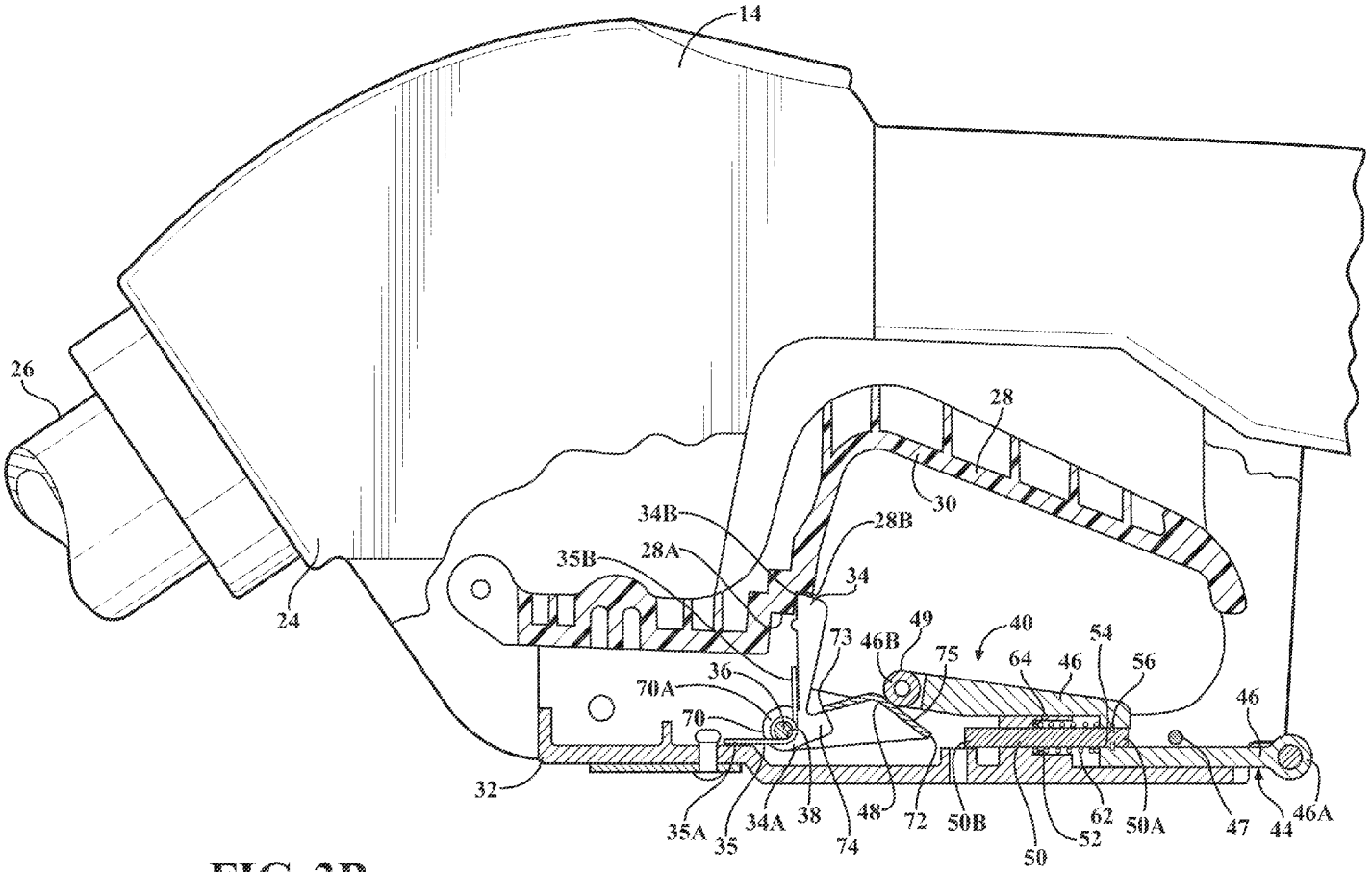
Figure 4:
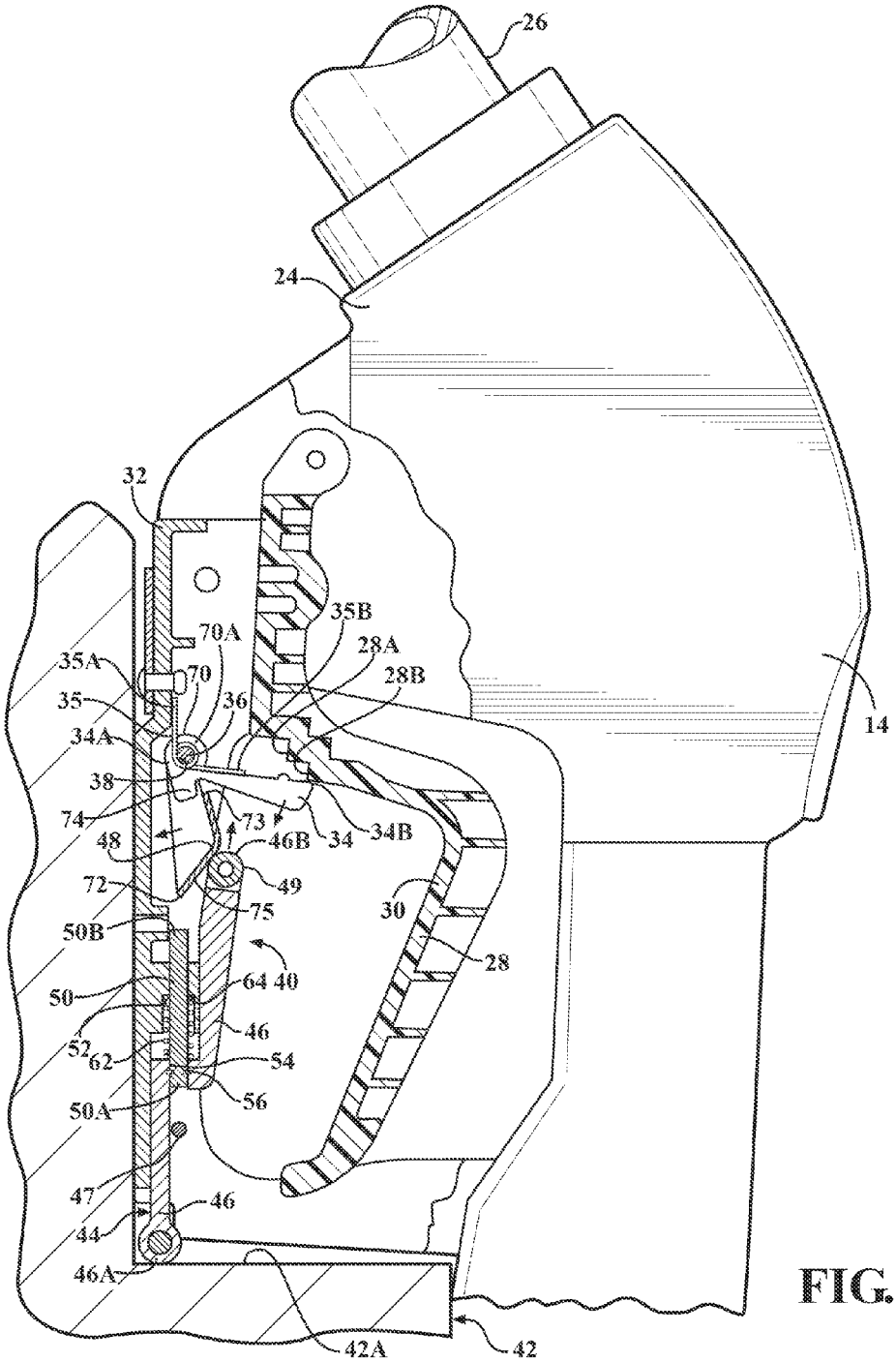
Figure 5:
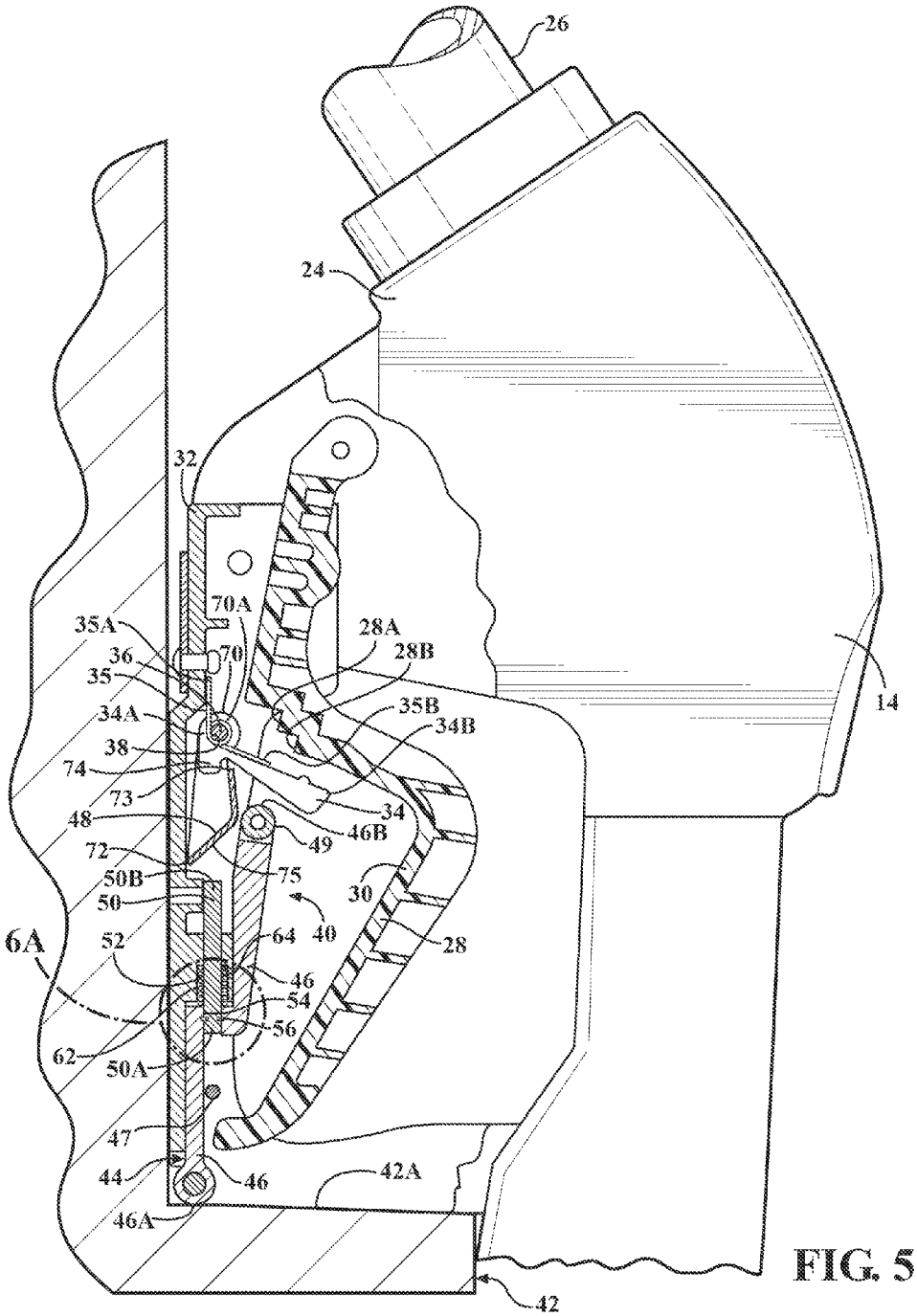

More particularly, the pivot bracket 48 moves the locking device 34 from either of the two illustrated nozzle hold open positions to the nozzle closed position. To that end, the pivot bracket 48 further includes a ramped surface 75 that is adapted to be engaged by the roller member 49 at the second end 46B of the slide bar 46. Specifically, the roller member 49 of the slide bar 46 rolls along the ramped surface 75 of the pivot bracket 48 as the slide bar 46 moves to its second position, which causes the second end 72 of the pivot bracket 48 to move toward the lever guard 32 causing movement of the locking device 34 from either of first and second enable hold open clip positions (FIGS. 3A, 3B) to a disable hold open clip position (FIGS. 2, 5).

Prior to a fueling operation, an operator grasps the main body 24 of the nozzle 14 and removes the nozzle 14 from the fuel pump cradle 42. Upon removing the nozzle 14 from the fuel pump cradle 42, the bias force exerted by the compression spring 62 on the slide bar 46 causes the guide rod 50 and the slide bar 46 to move, such that the slide bar 46 moves into its first position, shown in FIG. 2. As a result of the slide bar 46 moving into its first position, the roller member 49 at the second end 46B of the slide bar 46 disengages the ramped surface 75 of the pivot bracket 48, so as to free the pivot bracket 48 from being pinned between the roller member 49 and the lever guard 32.

To begin fueling, the operator squeezes the operating lever 28, which causes fuel to be dispensed out of the nozzle 14 and into the vehicle's fuel tank 18. If the operator wants to fuel the vehicle without continually squeezing the operating lever 28, the operator may pivot the locking device 34 against the bias force of the torsion spring 35 to move the locking device 34 from the nozzle closed position, illustrated in FIG. 2, into one of the first and second nozzle hold open positions, illustrated in FIGS. 3A and 3B, respectively, which positions maintain the operating lever 28 in respective hold open positions. For example, if the operator wishes the nozzle 14 to dispense fuel at a greater flow rate, the operator can position the locking device 34 in the first nozzle hold open position, illustrated in FIG. 3A. Or, if the operator wishes the nozzle 14 to dispense fuel at a lesser flow rate, the operator can position the locking device 34 in the second nozzle hold open position, illustrated in FIG. 3B. Movement of the locking device 34 into either of the illustrated nozzle hold open positions causes corresponding pivotal movement of the bracket 48 about a pivot axis defined by the rivet 36, i.e., via the extension 74 of the locking device 34 contacting the lip 73 of the pivot bracket 48. As a result, the pivot bracket 48 is moved into a path followed by the slide bar 46 when the slide bar 46 moves from its first position to its second position, as will be discussed herein.

Upon completion of fueling, the operator grasps the nozzle 14 and removes it from the filler pipe 16 of the vehicle 10. While the locking device 34 is normally released by the shut-off assembly built into the nozzle 14, if not, the operator may grasp the main body 24 of the nozzle 14 and squeeze the operating lever 28 to disengage the second end 34B of the locking device 34 from the corresponding detent 28A, 28B of the operating lever 28, which allows the bias force provided by the torsion spring 35 to pivot the locking device 34 from the corresponding nozzle hold open position (FIG. 3A or 3B) to the nozzle closed position (FIGS. 2 and 5).

If the locking device 34 is not released by the shut-off assembly built into the nozzle 14 and the operator does not squeeze the operating lever 28 after completing fueling, the operator may attempt to put the nozzle 14 back into the fuel pump cradle 42 with the operating lever 28 still in a hold open position. However, when the operator inserts the nozzle 14 into the fuel pump cradle 42, the first end 46A of the slide bar 46, which is positioned in the first position beyond the lever guard 32, contacts an extension 42A (see FIGS. 1, 4 and 5) of the fuel pump cradle 42. The contact with the extension 42A of the fuel pump cradle 42 causes the slide bar 46 to overcome the bias force provided by the compression spring 62 such that the slide bar 46 moves into its second position, i.e., substantially within the lever guard 32.

As the slide bar 46 moves toward its second position, the roller member 49 at the second end 46B of the slide bar 46 contacts the ramped surface 75 of the pivot bracket 48. Continued movement of the slide bar 46 toward its second position moves the pivot bracket 48 downward so that it pivots from the first or second enable hold open clip position to the disable hold open clip position. This movement of the pivot bracket 48 causes corresponding rotation of the locking device 34 from its first or second nozzle hold open position shown in FIGS. 3A and 3B respectively, to its nozzle closed position shown in FIG. 5 by means of the force transferred from the lip 73 of the pivot bracket 48 to the extension 74 of the locking device 34.

Referring to FIG. 5, once the nozzle 14 is released by the operator in the fuel pump cradle 42, the slide bar 46 remains in its second position as a result of the contact between the upper surface of the extension 42A of the fuel pump cradle 42 and the first end 46A of the slide bar 46. Further, the pivot bracket 48 is maintained in the disable hold open clip position and the locking device 34 is maintained in the nozzle closed position until an operator begins a subsequent fueling operation by removing the nozzle 14 from the fuel pump cradle 42.

Thus, the locking device release mechanism 40 of the present invention ensures that the nozzle 14 cannot be in the fuel pump cradle 42 with the operating lever 28 being maintained in a hold open position. The locking device release mechanism 40 may be provided in new nozzle designs, or may be installed in a pre-existing nozzle. For example, the lever guard of the pre-existing nozzle may be removed, and a lever guard 32 including the locking device release mechanism 40 may replace the removed lever guard.

Figure 8:
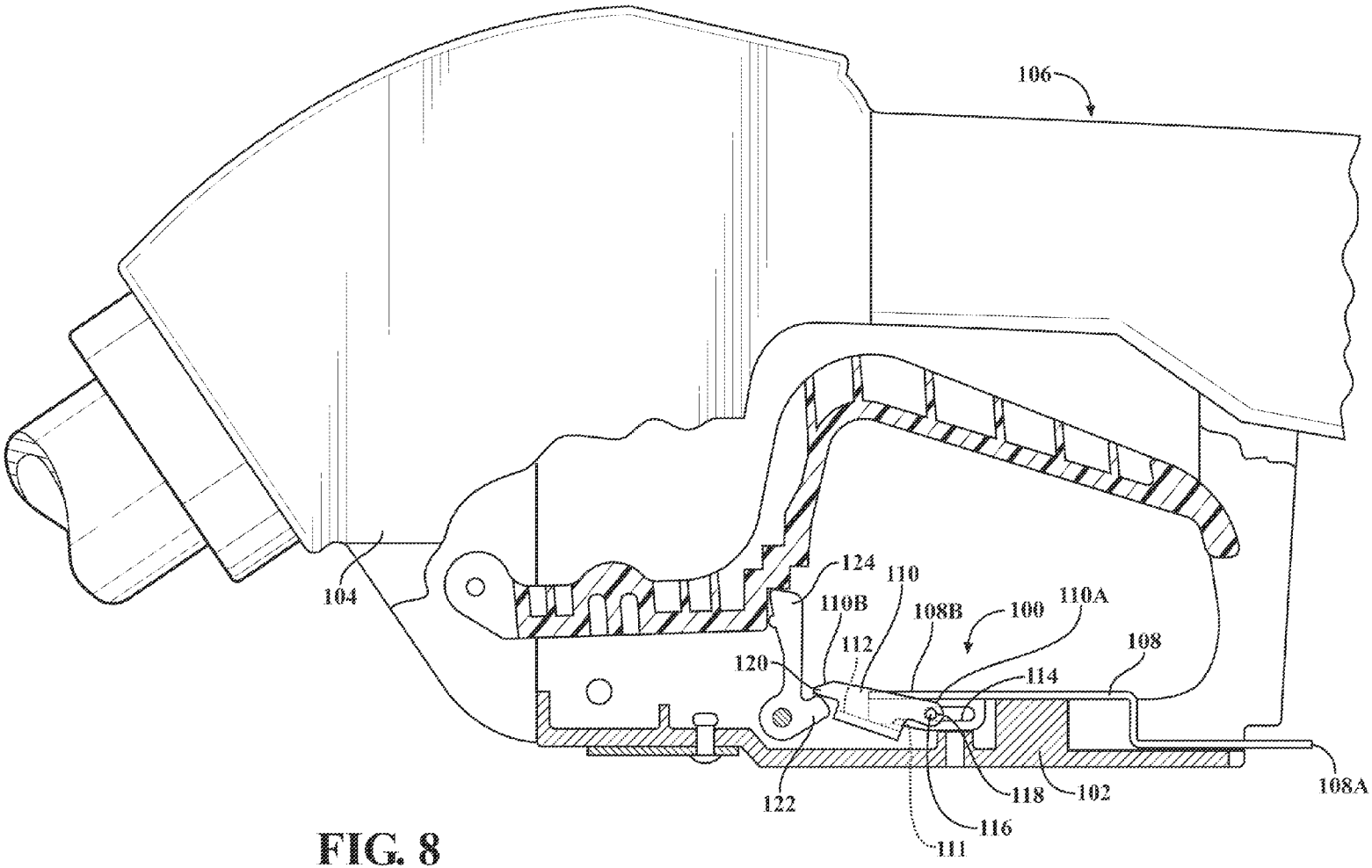
FIGS. 8-10 are side views, partially in cross section, illustrating a hold open clip release assembly according to another embodiment of the invention in successive positions as an associated fuel dispensing nozzle is used to dispense fuel and then stowed in a fuel pump cradle.
Figure 9:
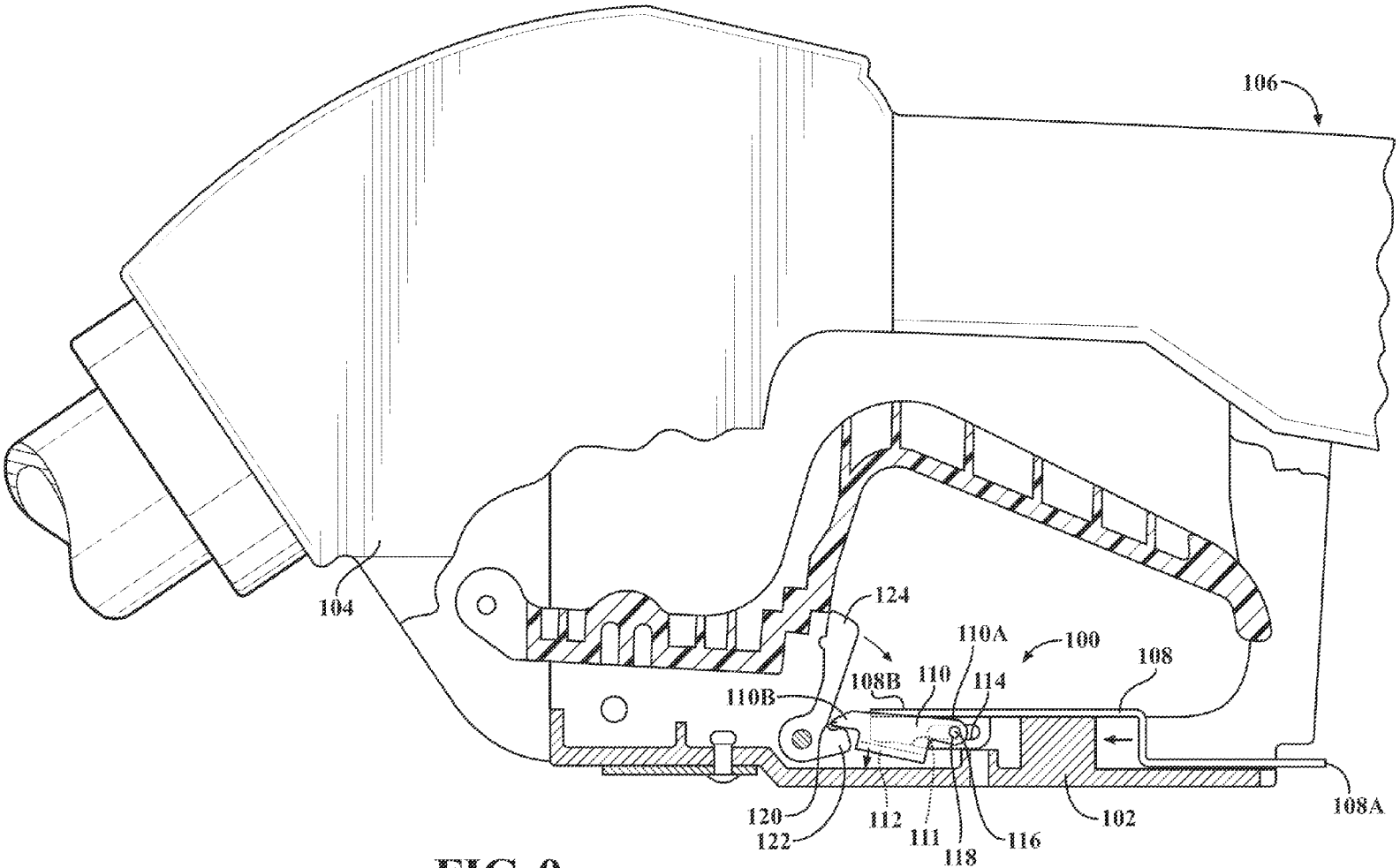
Figure 10:
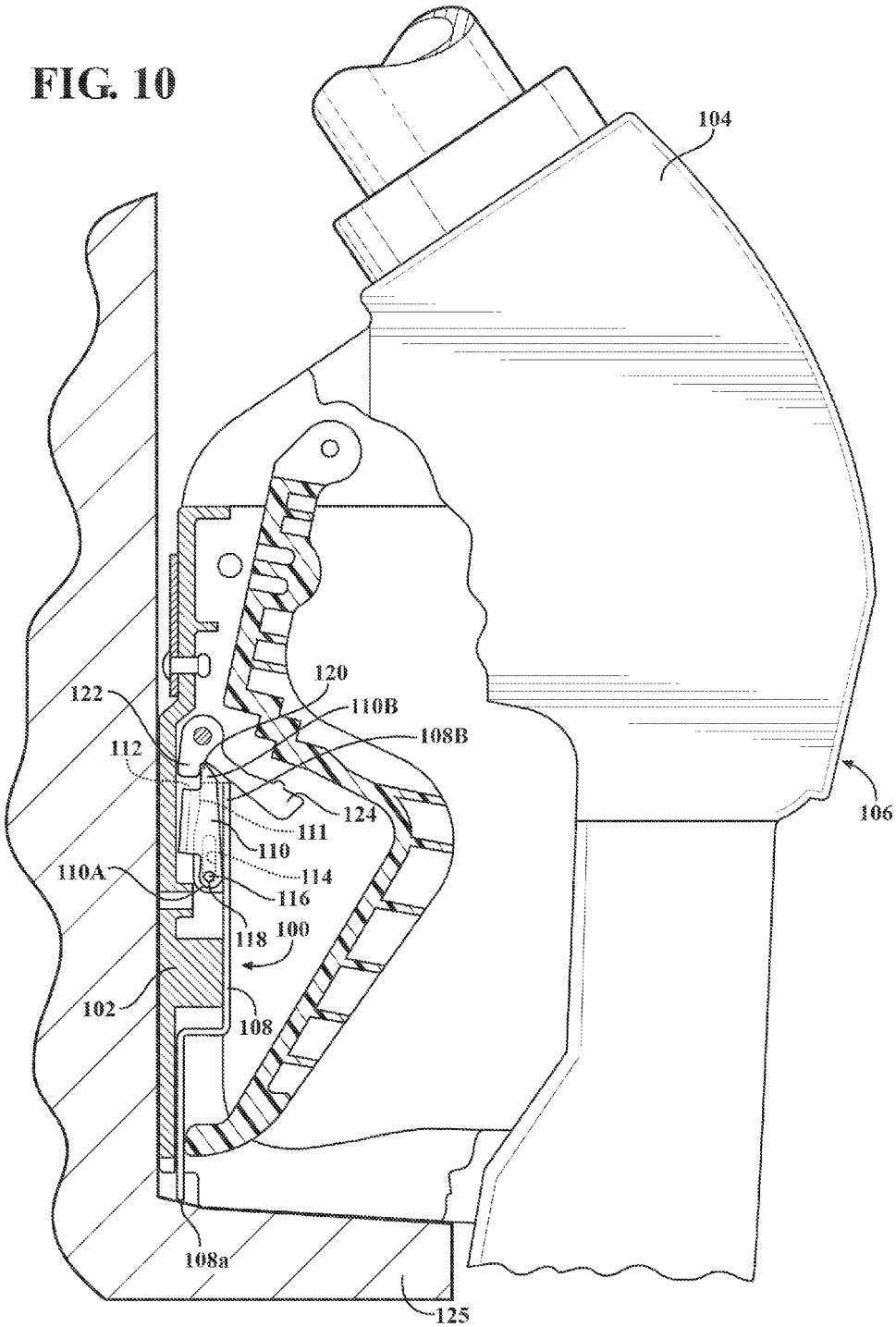

Referring now to FIGS. 8-10, a locking device release mechanism 100 according to another embodiment of the invention is shown. The locking device release mechanism 100 according to this embodiment is associated with a lever guard 102 of a main body 104 of a fuel dispensing nozzle 106. The locking device release mechanism 100 comprises a slide bar 108 and a pivot bracket 110.

The slide bar 108 is movable between a first position, illustrated in FIG. 8, wherein a first end 108A of the slide bar 108 extends beyond the main body 104 of the nozzle 106, i.e., beyond the lever guard 102, and a second position, illustrated in FIG. 10, wherein the first end 108A of the slide bar 108 is substantially within the main body 104 of the nozzle 106, i.e., substantially within the lever guard 102. The slide bar 108 may further be moved to other positions similar to those described above with reference to the slide bar 46, such as the position shown in FIG. 9. A second end 1088 of the slide bar 108 defines a rigid bottom surface 111, which bottom surface 111 is adapted to engage a ramped surface 112 of the pivot bracket 110 as will be described herein.

The slide bar 108 includes an elongate slot 114 that slidably receives a pin 116 therein. The pin 116 is secured to the lever guard 102 and slidably couples the slide bar 108 to the lever guard 102, i.e., the slide bar 108 moves from its first position to its second position by movement of the slide bar 108 such that the pin 116 moves within the slot 114.

The pivot bracket 110 comprises a first end 110A that includes a pair of openings 118, one opening 118 located adjacent each lateral side of the slide bar 108 and only one of which is shown in FIGS. 8-10. The openings 118 also receive the pin 116 such that the pin 116 pivotably couples the first end 110A of the pivot bracket 110 to the lever guard 102. A second end 110B of the pivot bracket 110 comprises a lip 120 that is adapted to engage an extension 122 of a locking device 124 so that movement of the locking device 124 and the pivot bracket 110 are coordinated, as described above.

Movement of the slide bar 108 from the first position toward the second position, e.g., as a result of the nozzle 106 being inserted into a fuel pump cradle 125 (see FIG. 10)

causes the bottom surface 111 at the second end 108B of the slide bar 108 to contact the ramped surface 112 of the pivot bracket 110. Continued movement of the slide bar 108 from the first position to the second position causes the second end 108B of the slide bar 108 to rotate the second end 110B of the pivot bracket 110 toward the lever guard 102. The movement of the second end 110B of the pivot bracket 110 toward the lever guard 102 causes corresponding movement of the locking device 124 from a nozzle hold open position, shown in FIG. 8, to a nozzle closed position, illustrated in FIG. 10.

Movement of the slide bar 108 from the second position to the first position is effected by an operator moving the locking device 124 from the nozzle closed position to a nozzle hold open position, i.e., rotation of the locking device 124 causes corresponding rotation of the second end 110B of the pivot bracket 110 away from the lever guard 102 via the contact between the lip 120 of the pivot bracket 110 and the extension 122 of the locking device 124. The movement of the second end 110B of the pivot bracket 110 away from the lever guard 102 causes the ramped surface 112 of the pivot bracket 110 to contact the bottom surface 111 at the second end 108B of the slide bar 108 and to move the slide bar 108 toward its first position.

The locking device release mechanism 100 can be used to prevent the nozzle 106 from being stowed in the fuel pump cradle with an associated operating lever 126 in a hold open position.

Figure 11:
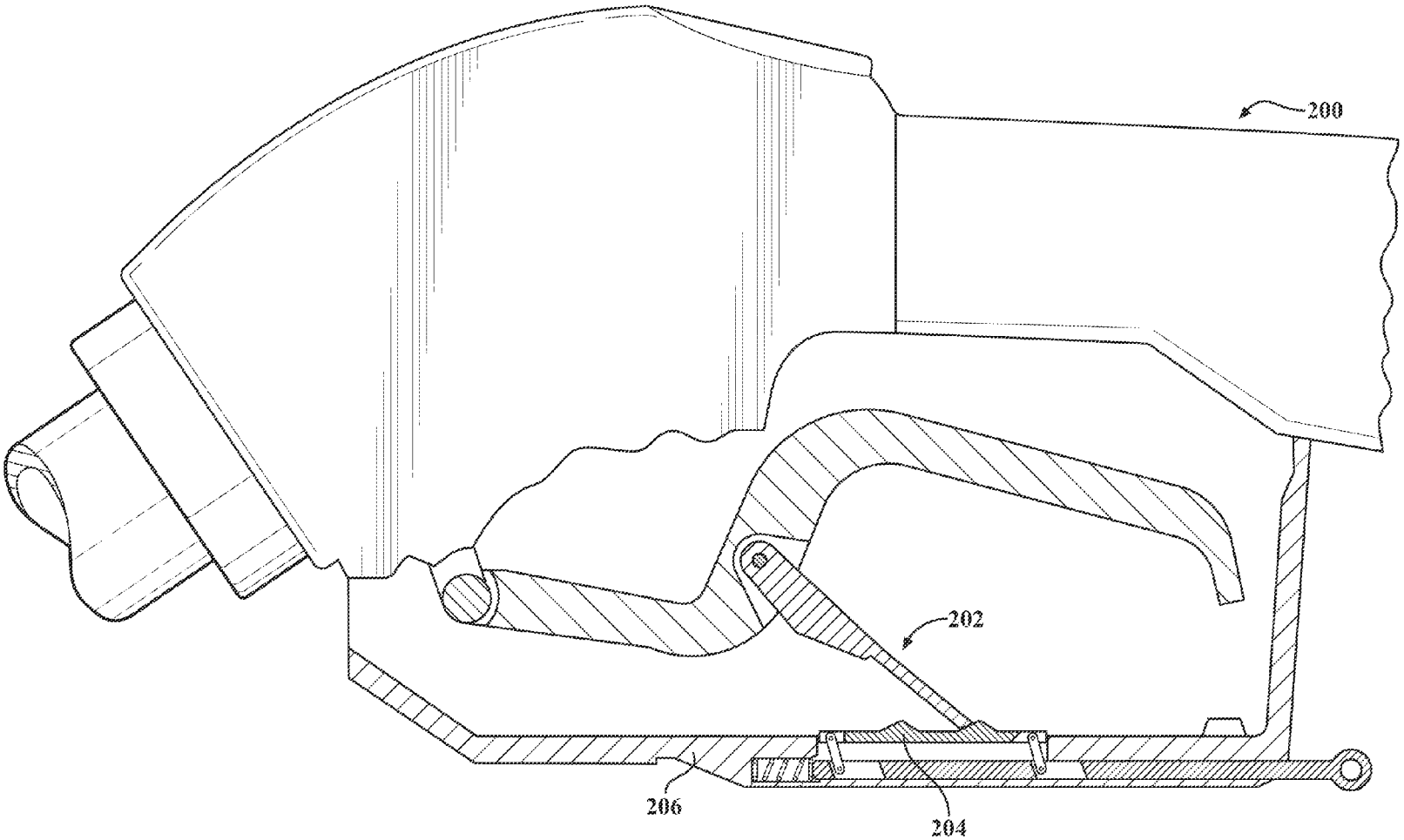
FIGS. 11 and 12, are side views, partially in cross section, illustrating a hold open clip release assembly according to yet another embodiment of the invention for a nozzle having a hold open device including a serrated plate in the bottom of the nozzle lever guard.
Figure 12:
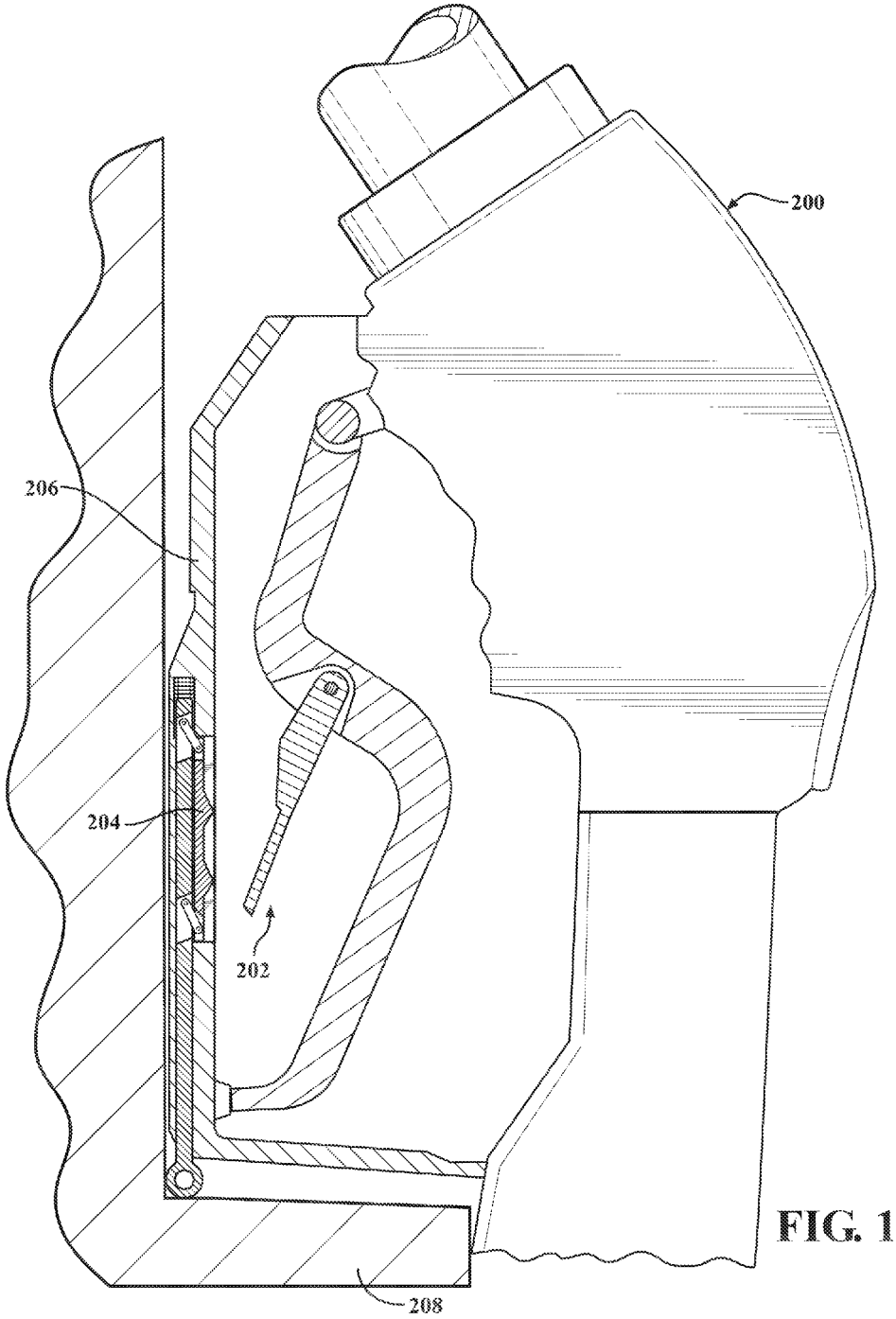

The locking device 34 is but one of a variety of nozzle hold open devices that are used. Many hold open devices are carried and deployed by the user of the fuel dispensing nozzle so that it is unlikely that they would be left by the user and, in any event, vary so greatly that a single release mechanism does not seem practical for such devices. However, other hold open devices that are incorporated into fuel dispensing nozzles could include a release mechanism in accordance with the teachings of the present application. As an example, an alternative embodiment for a nozzle 200 having a hold open device 202 including a serrated plate 204 in the bottom of the lever guard 206 is shown in FIGS. 11 and 12. Basic operation of this release mechanism is the same as far as removal of the nozzle 200 from its associated cradle 208 (FIG. 12) and replacement into the cradle 208. However, to accommodate the different hold open device 202, the mechanical operation is such that the serrated plate 204 is raised into an operating position when the nozzle 200 is removed from its cradle 208 and lowered out of an operating position when replaced into its cradle 208.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel dispensing nozzle hold open clip release assembly comprising:

a slide bar assembly associated with a nozzle lever guard and comprising:

a slide bar movable between a first position wherein a first end of said slide bar extends beyond said nozzle lever guard and a second position wherein said first end of said slide bar is substantially within said nozzle lever guard; and a first resilient member biasing said slide bar toward said first position;

a pivot bracket associated with and engaging a nozzle hold open clip, said pivot bracket and said hold open clip being mounted for pivotal movement relative to said nozzle lever guard so that said hold open clip can be moved between a nozzle closed position and at least one nozzle hold open position wherein said hold open clip engages at least one detent on a nozzle operating lever, and said pivot bracket can be moved between an enable hold open clip position and a disable hold open clip position;

a second resilient member for biasing said hold open clip toward said nozzle closed position; and wherein said slide bar engages and moves said pivot bracket when moving from said first position to said second position and said pivot bracket in turn moves said hold open clip from said at least one nozzle hold open position to said nozzle closed position.

2. The fuel dispensing nozzle hold open clip release assembly of claim 1, wherein said first end of said slide bar has a generally cylindrical shape.

3. The fuel dispensing nozzle hold open clip release assembly of claim 1, wherein a roller member is mounted on a second end of said slide bar opposite to said first end.

4. The fuel dispensing nozzle hold open clip release assembly of claim 3, wherein movement of said hold open clip to said at least one nozzle hold open position moves said pivot bracket into a path followed by said slide bar when said slide bar moves from the first position to the second position.

5. The fuel dispensing nozzle hold open clip release assembly of claim 4, wherein said roller member engages said pivot bracket when said slide bar moves from the first position to the second position whereby said hold open clip is moved to the nozzle closed position.

6. The fuel dispensing nozzle hold open clip release assembly of claim 5, wherein a guide rod is mounted to said slide bar, said guide rod being mounted to said nozzle lever guard for axial movement relative to a longitudinal portion of said nozzle lever guard and said first resilient member being coupled to said guide rod.

7. The fuel dispensing nozzle hold open clip release assembly of claim 1, wherein, upon said first end of said slide bar contacting a surface of a fuel pump cradle, said bias provided by said first resilient member is overcome such that said slide bar moves to its second position.

* * * * *